US005909739A

United States Patent [19]

Masrour-Rad

[11] Patent Number: 5,909,739

[45] Date of Patent: Jun. 8, 1999

[54] DISPOSABLE TOOTHBRUSH WITH TOOTHPASTE

[76] Inventor: Morad Masrour-Rad, 4044 Old Tapanga Cyn Rd., Calabasas, Calif. 91302

[21] Appl. No.: 08/880,030

[22] Filed: Jun. 20, 1997

[51] Int. Cl.[6] ..... A45D 44/18

[52] U.S. Cl. ..... 132/308; 132/309; 132/312; 132/314; 206/361; 206/362.2; 401/7; 15/167.1; 15/227

[58] Field of Search ..... 132/323, 324, 132/309, 308, 310; 15/227, 104.94, 167.1, 106, 109, 110, 102, 764; 206/362.2, 361, 362.4, 63.5; 401/7, 268, 191; 2/21; 433/216

*Primary Examiner*—Gene Mancene
*Assistant Examiner*—Pedro Philogene
*Attorney, Agent, or Firm*—Michael Farjami, Esq.

[57] ABSTRACT

The invention's toothbrush comprises an open end which is rolled up and placed in a small and convenient package. The closed end of the disposable toothbrush supports a number of clusters of bristles. The toothbrush is placed onto the user's index finger and is held tight by a small rolled up (i.e. unopened) portion near the base of the individual's index finger. The material near the tip (i.e. the closed end) of the toothbrush is thicker than the remainder of the toothbrush. The thicker material supports the bristles and permits a strong brushing action by the user. The toothbrush is carried along with toothpaste in a small package. In other embodiments of the invention, the disposable toothbrush can have ribs for massaging the gums and the package can contain some dental floss.

20 Claims, 2 Drawing Sheets

DISPOSABLE TOOTHBRUSH WITH TOOTHPASTE

BACKGROUND OF THE INVENTION

1. Field of the Invention

The present invention is generally related to toothbrushes and in particular to disposable toothbrushes packaged with accompanying toothpaste.

2. Background Art

Virtually everyone is aware that brushing the teeth is necessary for adding to the health and longevity of the teeth and also necessary for a pleasant appearance and smell of the teeth. In fact, dentists recommend that one's teeth be brushed once in the morning, after every meal, and once prior to retiring to bed at night. However, for practical reasons, many individuals do not regularly brush their teeth. Over time, the effect of irregular brushing is the build of plaque, onset of gingivitis, formation of cavities and a number of other health-related problems. Thus, although many individuals choose not to brush regularly due to inconvenience or impracticality, they will eventually spend much time and money to cure teeth related and health related problems that could have been prevented.

One primary reason for the impracticality of regular brushing is the difficulty that most individuals have with the inconvenience of carrying a toothbrush and its container and the required toothpaste and its separate container. Although toothbrushes, toothpastes and their respective containers are available in small as well as large sizes, there are many reasons why the mere reduction in the size of the present toothbrushes and toothpastes has not significantly reduced the inconvenience of carrying a separate toothbrush and separate toothpaste with their separate containers.

First, it is difficult to carry two separate items, i.e. a toothbrush separate from the toothpaste. Second, the toothbrush requires a protective container to keep the toothbrush from collecting dust, becoming dirty and unsanitary, being damaged, or causing damage to other items in its proximity. Third, the toothpaste manifestly requires a container to be held in and carried around. Thus, the amount of space consumed by the toothbrush, its container, and the toothpaste and its (separate) container usually exceeds the available space in a typical pocket or purse. Moreover, since the two necessary components, i.e. the toothbrush and the toothpaste are separate from each other, individuals often forget to take one or the other component. Further, toothbrushes shorter than four inches are impractical since they cannot reach the back of the mouth such that it becomes very difficult to reach and brush one's wisdom teeth. Thus, the toothbrush and its package are typically more than four inches in length. Also, the present toothbrushes and their accompanying packages are quite inflexible. Thus, it is very difficult to fit the toothbrush in cramped surroundings since a space for the exact dimensions of the toothbrush must be made available. Finally, the recurring cost of purchasing a small toothbrush and a small amount of toothpaste (and their containers) is prohibitive.

The above are some of the reasons for the impracticality of carrying a small toothbrush and toothpaste around when one leaves home. To applicant's knowledge no attempt has been made to overcome the impracticality of carrying a toothbrush and toothpaste in a convenient manner. Although there are a number of disposable personal care items in the market, such as disposable razors, to applicant's knowledge there are no practical and cost-effective disposable toothbrushes in the market that overcome the inconveniences and impracticalities that were discussed above.

Presently, a type of flexible instrument is used for massaging a baby's gums (prior to the time that the baby has developed any teeth). This flexible gum massager consists of a thin plastic tube. The parent's finger is inserted into the tube such that the tip of the finger is pressed against the closed end of the thin plastic tube. The thin plastic tube is designed such that it loosely fits over the parent's finger. The closed end of the plastic tube loosely fits over the tip of the parent's finger and has a few ribs (i.e. a few raised arcs) that are used to massage the baby's gums. However, such an instrument cannot work as a toothbrush and has never been used as a toothbrush. First, the flexible tube is loose and does not form a tight grip over the finger. Accordingly, it is extremely difficult for the baby gum massager to withstand the more rigorous adult tooth brushing action. Second, there are no bristles that can be used to brush the teeth. Third, there is no reason why adults would want to use such an instrument instead of a regular toothbrush since the instrument does not come with portable toothpaste and thus can be used only at home. In other words, if such an instrument must be used at home, one may simply use a regular toothbrush instead of such an instrument. Fourth, the material used for the baby's gum massager is latex (i.e. a thin plastic) that is not strong enough to support bristles for brushing action. Moreover, the baby gum massager is designed to have a loose fit over the parent's finger and does not grip the finger tight enough to permit either light or heavy brushing action.

Therefore, there is serious need in the art for a disposable and portable toothbrush and toothpaste that can be practically and conveniently carried around in small spaces such as one's pocket or wallet or a small purse. There is further need in the art for an effective and disposable toothbrush in order to make it practical and convenient to regularly brush one's teeth in various places such as the airport, the airplane, a hotel room, a restaurant, at work, and at school. There is also need in the art for a convenient package to carry the disposable toothbrush in a sanitary and safe manner. Moreover, there is need in the art to have a low cost disposable toothbrush such that its disposal does not amount to "waste" of money.

SUMMARY OF THE INVENTION

The present invention is a disposable toothbrush with toothpaste. The invention's disposable toothbrush can be conveniently carried and used anywhere away from home. The invention's disposable toothbrush can be conveniently carried and used at work, on vacation, in a restaurant, at the airport or on the airplane. Moreover, the invention's disposable toothbrush is inexpensive and cost effective. Further, the invention's disposable toothbrush can be used with great control and flexibility, thus making it even more effective in preventing teeth disease than the standard home toothbrush. Accordingly, the health benefits of the invention's disposable toothbrush to the individual and the society as a whole are tremendous.

The invention's toothbrush comprises an open end which is rolled up and placed in a small and convenient package. The closed end of the disposable toothbrush supports a number of clusters of bristles. The toothbrush is placed onto the user's index finger and is held tight by a small rolled up (i.e. unopened) portion near the base of the individual's index finger. The material near the tip (i.e. the closed end) of the toothbrush is thicker than the remainder of the toothbrush. The thicker material supports the bristles and permits a strong brushing action by the user. The toothbrush is carried along with toothpaste in a small package. In other embodiments of the invention, the disposable toothbrush can have ribs for massaging the gums and the package can contain some dental floss.

DETAILED DESCRIPTION OF THE INVENTION

The present invention is a disposable toothbrush with toothpaste. Although the invention is described with respect to certain specific embodiments, the principles of the invention, as defined by the claims appended herein, can obviously be applied beyond the specifically described embodiments. Moreover, in the description of the present invention, certain details have been left out in order to not obscure the inventive aspects of the invention. The details left out are within the knowledge of a person of ordinary skill in the art and can be filled in by such a person. For example, although the invention's disposable toothbrush has been described as being made of natural or synthetic rubber, the invention's disposable toothbrush may also be made of any other flexible and disposable material.

Figure 1:
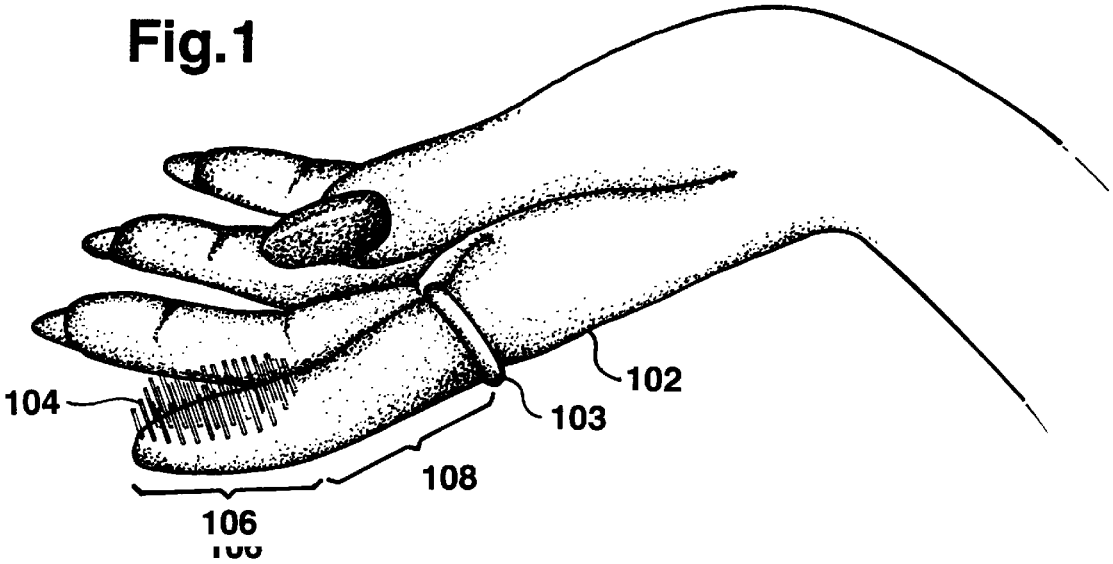
FIG. 1 illustrates a side view of the invention's disposable toothbrush.

The present invention is now described in detail by reference to the drawings. FIG. 1 shows a side view of the invention's disposable toothbrush 100 worn over a person's index finger. Except for the top third portion of the toothbrush, the invention's disposable toothbrush 100 is made up of a thick and elastic natural or synthetic rubber that snugly grips the base of an individual's index finger 102 as shown in FIG. 1. When completely rolled open, disposable toothbrush 100 is approximately 4.0 inches long. However, depending on the length of the person's index finger, disposable toothbrush 100 would not be entirely rolled open. Typically between two and three inches of the invention's disposable toothbrush is rolled open while the remaining two to one inch would remain rolled up (i.e. unopened). The rolled up part (i.e. the unopened part) of the invention's disposable toothbrush 100 is pointed to by numeral 103 in FIG. 1. The rolled up portion 103 is required to keep the open end of the disposable toothbrush tight around the user's index finger.

The closed end of the invention's disposable toothbrush 100 has no openings and entirely covers the user's index finger; thus the disposable toothbrush can be put on and taken off only through its open end. As shown in FIG. 1, the closed end of disposable toothbrush 100 supports a number of clusters of bristles 104. Bristles 104 are approximately 3.0 millimeters in height. The clusters of bristles 104 occupy approximately one third of the length of the disposable toothbrush, beginning with the tip of the disposable toothbrush and ending at a point one third of the way between the tip and the rolled up portion 103 of the toothbrush. Thus, the clusters of bristles 104 occupy an area approximately one inch in length. As shown in FIG. 1, bristles 104 are placed only on one side of disposable toothbrush 100, namely only on the side opposite to the finger.

The top one third of the invention's disposable toothbrush (pointed to by numeral 106) and bristles 104 of the invention's disposable toothbrush are typically made of a plastic material less elastic and harder than the natural or synthetic rubber that makes up the remainder of disposable toothbrush 100. The plastic material making up area 106 (as support for bristles 104) is also thicker than the natural or synthetic rubber making up the remainder of disposable toothbrush 100. The thicker material is required to provide sufficient support for bristles 104 and also to ensure that the top portion of the disposable toothbrush tightly covers the tip of the index finger and does not easily move from side to side during the brushing action. This ensures that the user can effectively and efficiently engage bristles 104 with various areas of the individual's teeth and the areas between the teeth (the portion of the disposable toothbrush that does not support bristles 104 is pointed to by numeral 108 for future reference).

Figure 2:
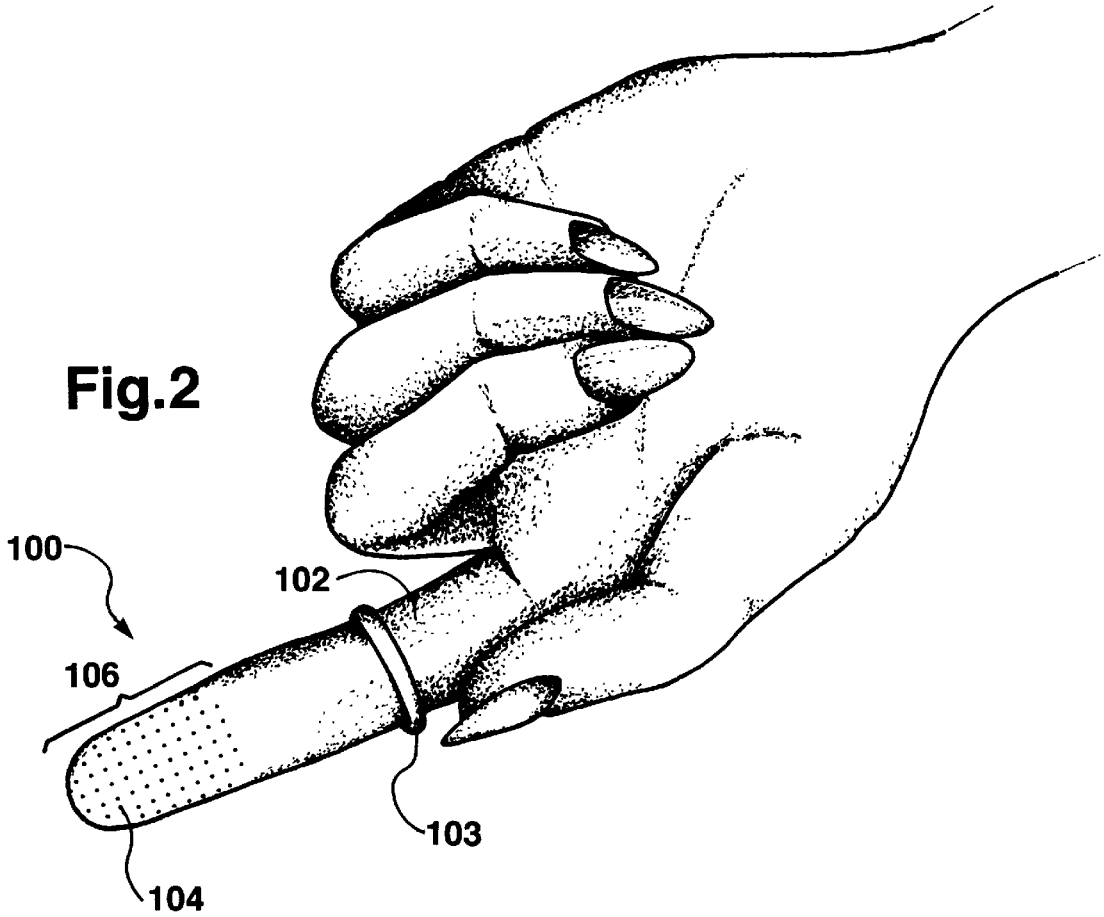
FIG. 2 illustrates a top view of the invention's disposable toothbrush.

FIG. 2 shows a top view of disposable toothbrush 100 of the present invention. As in FIG. 1, the user's index finger is indicated by numeral 102. Disposable toothbrush 100 is rolled open over the user's index finger such that bristles 104, in the top area 106 are placed over the tip of the user's index finger. As explained in relation to FIG. 1, the rolled up portion (i.e. the unopened portion) 103 helps keep the disposable toothbrush tight around the user's index finger. As shown in FIG. 2, bristles 104 cover the entire area 106 which has a length of approximately one-third of the length of the entire disposable toothbrush.

Figure 3:
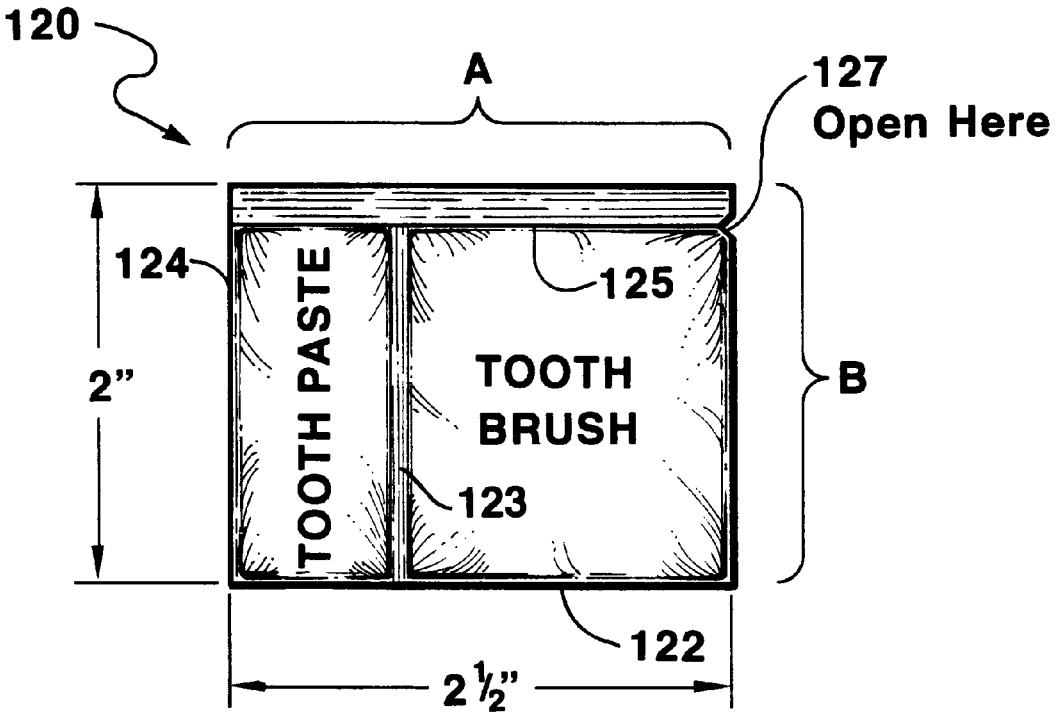
FIG. 3 shows the invention's package for the invention's disposable toothbrush and toothpaste.
Figure 4:
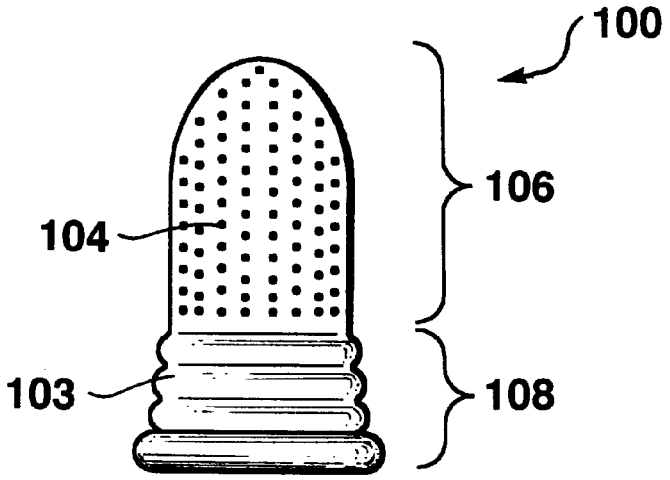
FIG. 4 illustrates the configuration of the invention's disposable toothbrush as it lies flat in the toothbrush compartment of the invention's portable package.

FIG. 3 shows the package of the disposable toothbrush and toothpaste of the present invention. Package 120 shown in FIG. 3 comprises two rectangular compartments. In the first rectangular compartment 122 disposable toothbrush of the present invention is placed and the second rectangular compartment 124 contains toothpaste for use with the disposable toothbrush. The disposable toothbrush is laid flat in rectangular compartment 122 with portion 108 completely rolled up. FIG. 4 shows the configuration of disposable toothbrush 100 when it lies flat in package 120. Area 106 supporting bristles 104 is not folded. However, area 108 which does not support bristles 104 (and is made up of natural or synthetic rubber that is thinner than the hard plastic of area 106) is completely rolled up. Thus, when disposable toothbrush 100 is placed inside package 120, area 108 would be the same as the rolled up portion 103 as shown in FIG. 4. In other words, the entire portion of the toothbrush that does not contain bristles is rolled up and placed in package 120.

Referring back to FIG. 3, it is noted that side A of package 120 is approximately 2.5 inches and side B of package 120 is approximately 2 inches. A pressed line forms a tight seal between compartment 122 and compartment 124 such that none of the toothpaste in compartment 124 can enter the toothbrush compartment 122. To use the package of the disposable toothbrush, the package is torn open at point 127 along line 125. This enables the user to take out the disposable toothbrush and place it on his or her finger as described above. Also, upon opening the package along line 125, toothpaste can be squeezed out of the package and applied to bristles 104 of the disposable toothbrush. Package 120 is typically made of a thin plastic or similar material used in packaging food products such as ketchup or mayonnaise. At its thickest point, package 120 is approximately four millimeters thick. Toothpaste compartment 124 can contain any type of commercially available toothpaste such as tartar control toothpaste, baking soda, or "Sensitive" toothpaste.

The fact that the toothpaste compartment 124 and toothbrush compartment 122 are contiguous makes for ease and convenience in transportation and use of the disposable toothbrush of the present invention. In operation, the user simply tears the package along line 125 and places the disposable toothbrush on his or her index finger. Thereafter, the user rolls open the disposable toothbrush such that only a small portion 103 remains unrolled. As explained above, portion 103 grips the index finger of the user such that brushing action can be effectively performed. The user then applies a desired amount of toothpaste from compartment 124 to bristles 104 of the disposable toothbrush. Due to the ability of the finger to move around in tight spaces and, at the same time, providing great control and flexibility, the invention's disposable toothbrush is even more effective in reaching the desired locations of the user's teeth than the standard toothbrush used at home.

In other embodiments, the disposable toothbrush of the present invention can be made even more versatile and beneficial. For example, semi-circular ribs (or bumps) can be added to the side opposite to bristles 104. The ribs (or bumps) can be used for massaging the gums and increasing blood circulation in the gums. In another embodiment, the package of the disposable toothbrush of the present invention can be modified to house a foot-long dental floss which can be conveniently used by the individual carrying package 120.

Although the present invention has been described with reference to specific embodiments, it is appreciated by those skilled in the art that changes in various details may be made without departing from the scope and spirit of the invention as defined by the appended claims. For example, the specific geometry, sizes, and materials disclosed herein as well as the color of the disposable toothbrush and/or toothpaste can be changed without departing from the scope of the invention as disclosed and claimed in this application.

Thus, a disposable toothbrush with toothpaste has been described.

I claim:

1. A toothbrush comprising:

an elastic tube having a closed end and an open end;

a first side of said closed end supporting a plurality of clusters of bristles;

said closed end being made of material of a first elasticity and said open end being made of material of a second elasticity, said second elasticity being greater than said first elasticity;

said open end permitting a finger to be inserted into said elastic tube, whereby a tooth can be brushed using said plurality of clusters of bristles.

2. The toothbrush of claim 1 wherein said material of said first elasticity is a plastic material.

3. The toothbrush of claim 2 wherein said material of said second elasticity is a natural rubber material.

4. The toothbrush of claim 2 wherein said material of said second elasticity is a synthetic rubber material.

5. The toothbrush of claim 1 wherein said plurality of clusters of bristles are made of said material of said first elasticity.

6. The toothbrush of claim 1 having a plurality of ribs on a second side of said closed end, said second side of said closed end being on an opposite side of said first side of said closed end.

7. A portable package comprising:

a toothbrush compartment for housing a toothbrush;

a toothpaste compartment for holding toothpaste;

a divider placed between said toothbrush and toothpaste compartments for preventing said toothpaste from entering said toothbrush compartment;

said toothbrush comprising:

an elastic tube having a closed end and an open end;

a first side of said closed end supporting a plurality of clusters of bristles;

said closed end being made of material of a first elasticity and said open end being made of material of a second elasticity, said second elasticity being greater than said first elasticity;

said open end permitting a finger to be inserted into said elastic tube, whereby a tooth can be brushed using said plurality of clusters of bristles.

8. The portable package of claim 7 wherein said toothbrush is rolled up inside said toothbrush compartment.

9. The portable package of claim 7 wherein said toothpaste is selected from the group consisting of tartar control toothpaste, baking soda toothpaste, and sensitive toothpaste.

10. The portable package of claim 7 wherein said divider is a pressed line.

11. The portable package of claim 7 further comprising a compartment for housing dental floss.

12. The portable package of claim 7 wherein said package is made of a plastic material.

13. The portable package of claim 7 wherein said package is torn open by a user so as to permit said user to take out said toothbrush.

14. The portable package of claim 13 wherein said package is torn open by said user so as to permit said user to apply said toothpaste to said toothbrush.

15. A toothbrush comprising:

an elastic tube having a closed end and an open end;

a first side of said closed end supporting a plurality of clusters of bristles;

said closed end being made of material of a first elasticity and said open end being made of material of a second elasticity, said second elasticity being greater than said first elasticity;

said open end permitting a finger to be inserted into said elastic tube, whereby a tooth can be brushed using said plurality of clusters of bristles;

said toothbrush including a plurality of ribs on a second side of said closed end, said second side of said closed end being on an opposite side of said first side of said closed end;

wherein said plurality of clusters of bristles have a height of approximately three millimeters and cover approximately one inch of said toothbrush, said toothbrush being approximately four inches in length.

16. The toothbrush of claim 15 wherein said material of said first elasticity is a plastic material.

17. The toothbrush of claim 15 wherein said material of said second elasticity is a natural rubber material.

18. The toothbrush of claim 15 wherein said material of said second elasticity is a synthetic rubber material.

19. The toothbrush of claim 15 wherein said plurality of clusters of bristles are made of said material of said first elasticity.

20. A portable package comprising:

a toothbrush compartment for housing a toothbrush;

a toothpaste compartment for holding toothpaste;

a divider placed between said toothbrush and toothpaste compartments for preventing said toothpaste from entering said toothbrush compartment;

said toothbrush comprising:

an elastic tube having a closed end and an open end;

a first side of said closed end supporting a plurality of clusters of bristles;

said closed end being made of material of a first elasticity and said open end being made of material of a second elasticity, said second elasticity being greater than said first elasticity;

said open end permitting a finger to be inserted into said elastic tube, whereby a tooth can be brushed using said plurality of clusters of bristles;

wherein said portable package is a rectangle having a first side of approximately two inches and a second side of approximately two and a half inches and a maximum thickness of four millimeters.

* * * * *